US010407912B1

(12) United States Patent
White

(10) Patent No.: US 10,407,912 B1
(45) Date of Patent: Sep. 10, 2019

(54) ROOF SHEETING ANCHORING SYSTEM AND METHOD

(71) Applicant: Charles Randall White, Oakland Park, FL (US)

(72) Inventor: Charles Randall White, Oakland Park, FL (US)

( * ) Notice: Subject to any disclaimer, the term of this patent is extended or adjusted under 35 U.S.C. 154(b) by 0 days.

(21) Appl. No.: 16/365,650

(22) Filed: Mar. 26, 2019

(51) Int. Cl.
*E04D 3/36* (2006.01)
*E04B 7/16* (2006.01)

(52) U.S. Cl.
CPC ..... *E04D 3/3607* (2013.01); *E04B 7/163* (2013.01)

(58) Field of Classification Search
CPC ..... E04B 1/2612; E04B 1/2608; E04B 7/045; E04D 3/36; E04D 3/3605
See application file for complete search history.

(56) References Cited

U.S. PATENT DOCUMENTS 4,449,335 A * 5/1984 Fahey ..... E04B 1/2608 52/713
4,592,186 A * 6/1986 Braginetz ..... E04B 1/2604 403/396
4,961,553 A * 10/1990 Todd ..... F16B 37/045 248/62
5,555,694 A * 9/1996 Commins ..... E04B 1/2612 248/300
5,699,639 A * 12/1997 Fernandez ..... E04B 1/4107 52/295
5,799,907 A * 9/1998 Andronica ..... F16L 3/24 248/62
6,560,943 B1 5/2003 Leek et al.
6,763,634 B1 * 7/2004 Thompson ..... E04B 7/045 52/167.1
7,814,710 B2 * 10/2010 Foglia ..... E04B 1/4107 52/709
7,814,719 B2 10/2010 Cretti
2005/0011157 A1 1/2005 Lutz et al.
2006/0059794 A1 * 3/2006 Gilstrap ..... E04B 7/045 52/90.1
2008/0277551 A1 * 11/2008 Hackney ..... E04B 1/2604 248/276.1

* cited by examiner

*Primary Examiner* — Christine T Cajilig
(74) *Attorney, Agent, or Firm* — Integrity Patent Group, PLC; Charles E. Runyan

(57) ABSTRACT

A roof sheeting anchoring system is disclosed including a channel assembly, a pair of anchoring bodies, and a foot. The channel assembly includes a plurality of fastener holes. The anchoring bodies include a flat and tapered end connected to truss-anchor hooks. The anchoring bodies are each removably insertable into the channel assembly. The foot is rotatably affixable to both of the bodies at the attachment points. Each foot includes at least one fastener hole. The roof sheeting anchoring system securely attaches a roof structure to a truss to prevent separation between the roof and the truss. The method of using a roof sheeting anchoring system is included.

18 Claims, 5 Drawing Sheets

ROOF SHEETING ANCHORING SYSTEM AND METHOD

CROSS-REFERENCE TO RELATED APPLICATION(S)

The present application is related to and claims priority to U.S. Provisional Patent Application No. 62/660,242 filed Apr. 19, 2018, which is incorporated by reference herein in its entirety.

BACKGROUND OF THE INVENTION

The following includes information that may be useful in understanding the present disclosure. It is not an admission that any of the provided information is prior art nor material to the presently described or claimed inventions, nor that any publication or document that is specifically or implicitly referenced is prior art.

Technical Field

The present invention relates generally to the field of structural building member securement of existing art and more specifically relates to an adjustable roof sheeting anchorage system and method.

Related Art

Roof sheeting anchoring systems are designed for securing roofs and roofing components to other structural components of buildings including trusses and other structural support members. Anchoring systems are especially useful, and often necessary, in the prevention of roof damage or roof collapse during the uplift or horizontal wind flow that occurs during inclement weather such as hurricanes, tornadoes and other high-wind situations. Adding to the problem is that in order for developers to satisfy the need for affordable housing, which oftentimes is high-density and in high-wind areas, they construct housing built to lower construction standards. Due to unpredictable weather conditions as well as the lower construction standards and the continuous increase in density of dwellings located in known high-wind areas, there is a growing need for reliable roof sheeting anchoring systems.

There are numerous anchor systems that may be used in home construction, or later added to increase architectural soundness. In one iteration, a one-piece anchor with leg portions is embedded into a cementitious roof or other cementitious material. The top portion of this iteration must be secured, usually using nails, to roof trusses. This design is permanent and almost always requires the anchoring system be installed during the building's construction and requires a professional engineer to perform load and stress analysis at each attachment point. This process is time consuming and creates increased costs and delays in building construction.

In another iteration, a system is used to secure roofing components to connector plates that attach to a track that runs horizontally along the top of a building's support wall. Track systems normally require specific sizes of surface area connections and roof component design and are permanent. Still other iterations are simple plates that must be hammered into wooded trusses and support beams. These plates are prone to failure due to weathering and stress. A suitable solution is desired.

U.S. Pat. No. 7,814,710 to Silvino R. Foglia relates to a roof anchoring system. The described roof anchoring system includes an infinitely adjustable anchoring system for attaching structural members to a support member. The system comprises a continuous, elongated, removable retaining track secured to the outer surface of a support member and configured to receive at least one adjustable connector plate therein. The adjustable connector plates are capable of attaching to structural members having various dimensions and pitches relative to the track. The invention includes a reusable centering bracket assembly used to install a retaining track assembly along an upper portion of a support member.

SUMMARY OF THE INVENTION

In view of the foregoing disadvantages inherent in the known structural building member securement art, the present disclosure provides a novel roof sheeting anchoring system and method. The general purpose of the present disclosure, which will be described subsequently in greater detail, is to provide a roof sheeting anchoring system and method.

A roof sheeting anchoring system is disclosed. The roof sheeting anchoring system includes a channel assembly, a pair of anchoring bodies, and a foot. In some embodiments, the channel assembly includes a rectangular channel with an opening and a flap. The flap is affixed to a corner at substantially 90 degrees to a side of the rectangular channel Also, the channel assembly includes a plurality of holes structured and arranged to accept fasteners.

Each of the anchoring bodies includes an elongate member with a flat and tapered end including a truss-anchor hook and with a rounded end. Additionally, a pair of attachment points is located near the rounded end. The flat and tapered end includes a twist of substantially 90 degrees, and the anchoring bodies include at least one opening to accept fasteners. The anchoring bodies are each removably insertable into the channel assembly.

In some cases, the foot is rotatably affixable to both of the anchoring bodies at the attachment points, with each of the attachment points including an aperture for a fastener. Also, each foot is removably and rotatably coupleable to the anchoring bodies through the attachment points. Additionally, each foot includes at least one foot aperture to accept a fastener. In some embodiments, the system is constructed from a ferrous material, and the material is galvanized.

The roof sheeting anchoring system provides a secure attachment between a roof structure sheathing or sheeting and a truss. The attachment prevents the sheeting from separating from the truss. This may be at least partially accomplished by members that wrap around the bottom of a truss and lock into a channel.

According to another embodiment, a method of using a roof sheeting anchoring system is also disclosed. The method of using a roof sheeting anchoring system includes a first step of providing a roof sheeting anchoring system in which the system includes a channel assembly, anchoring bodies, and a foot. The method includes another step of affixing the channel assembly to roof sheathing or sheeting. The method includes yet another step of affixing the foot to an underside of a truss. The method includes inserting fasteners into the roof sheeting anchoring system and therefore into the building.

For purposes of summarizing the invention, certain aspects, advantages, and novel features of the invention have been described. It is to be understood that not necessarily all such advantages may be achieved in accordance with any one particular embodiment of the invention. Thus, the invention may be embodied or carried out in a manner that achieves or optimizes one advantage or group of advantages as taught without necessarily achieving other advantages as may be taught or suggested. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a roof sheeting anchoring system and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to structural building member securement and more particularly to a roof sheeting anchoring system and method as used to improve the structural integrity of a building by providing an improved device for securing roof sheathing or sheeting. For purposes of this disclosure, sheeting and sheathing are used interchangeably.

Generally, the system includes two components that, together, lock down the perimeter of a roof's sheeting onto the top of a truss with components fastening around the underside of the truss to prevent wind-related storm events such as hurricanes from removing the sheeting. The strap system begins with a square metallic tube that has a thickness similar to the sheeting used on the roof. A flap extending from the top side of the tube overlaps the sheeting. In some embodiments, the flap overlaps the sheeting by 1-½". Under the flap, in some cases directly under the flap, in the square tube, is a slot that forms a channel. Upper and lower long tabs 115 are disposed at a 45-degree angle extending into the channel top and bottom around ¼". The channel and tabs connect to the second component.

The second component, the anchor assembly, starts with two ¼" tabs, one on each strap end. One tab is oriented upward and the other downward to lock into upper and lower long tabs 115. There is a 90-degree twist in the strap such that the adjustable (e.g., to accommodate different truss sizes) strap will lay flat along each side of the truss. At the other end is a shoe or foot that is coupled on each side to the straps, allowing the system to accommodate different roof pitches. In some embodiments, the shoe or foot is rotatably coupled.

Referring now more specifically to the drawings by numerals of reference, there is shown in FIGS. 1-4, various views of a roof sheeting anchoring system 100.

Figure 1:
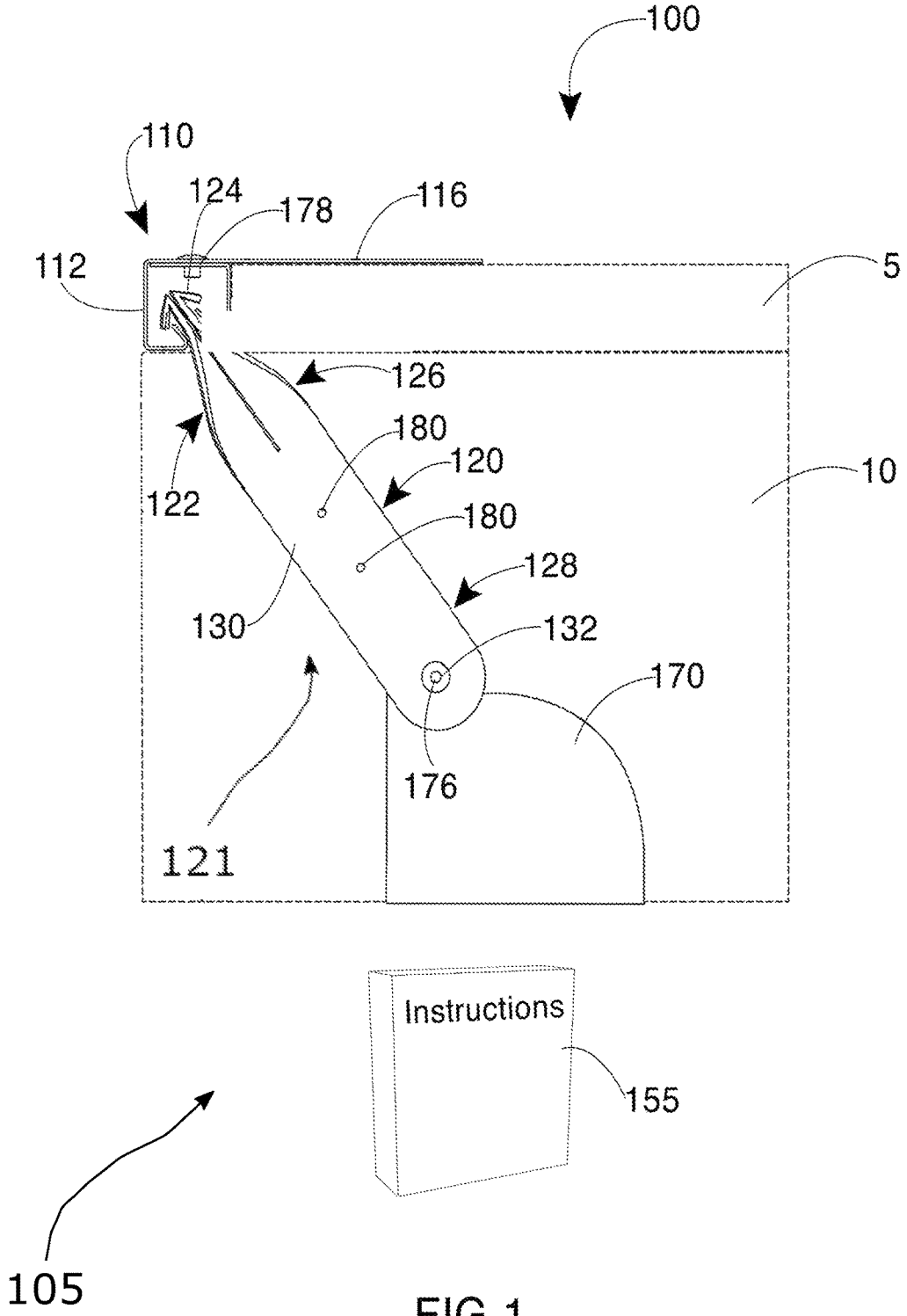
FIG. 1 is a side view of the roof sheeting anchoring system during an 'in-use' condition, according to an embodiment of the disclosure.
Figure 2:
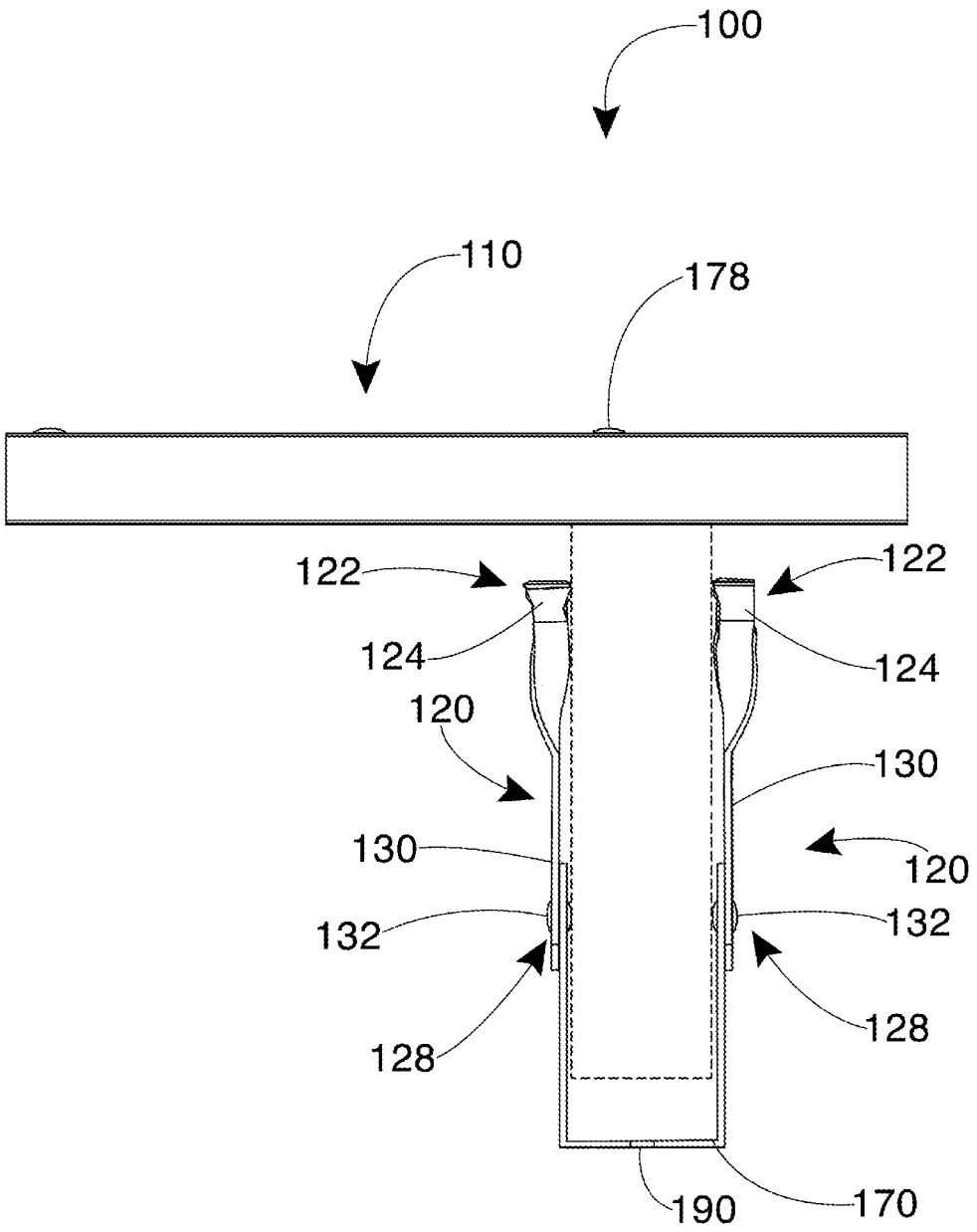
FIG. 2 is a front view of the roof sheeting anchoring system of FIG. 1, according to an embodiment of the present disclosure.
Figure 3:
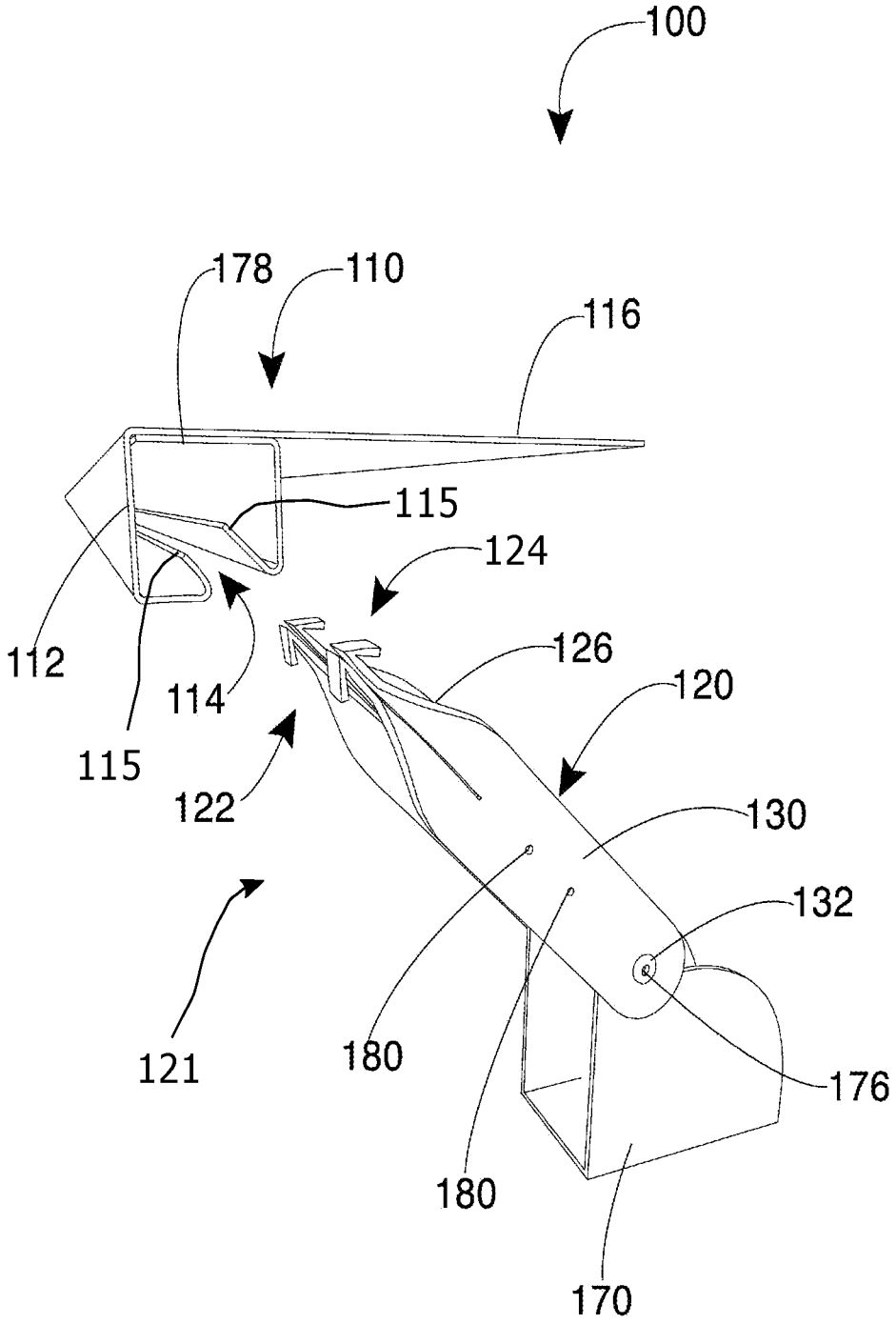
FIG. 3 is a side perspective view of the roof sheeting anchoring system of FIGS. 1 and 2, according to an embodiment of the present disclosure.
Figure 4:
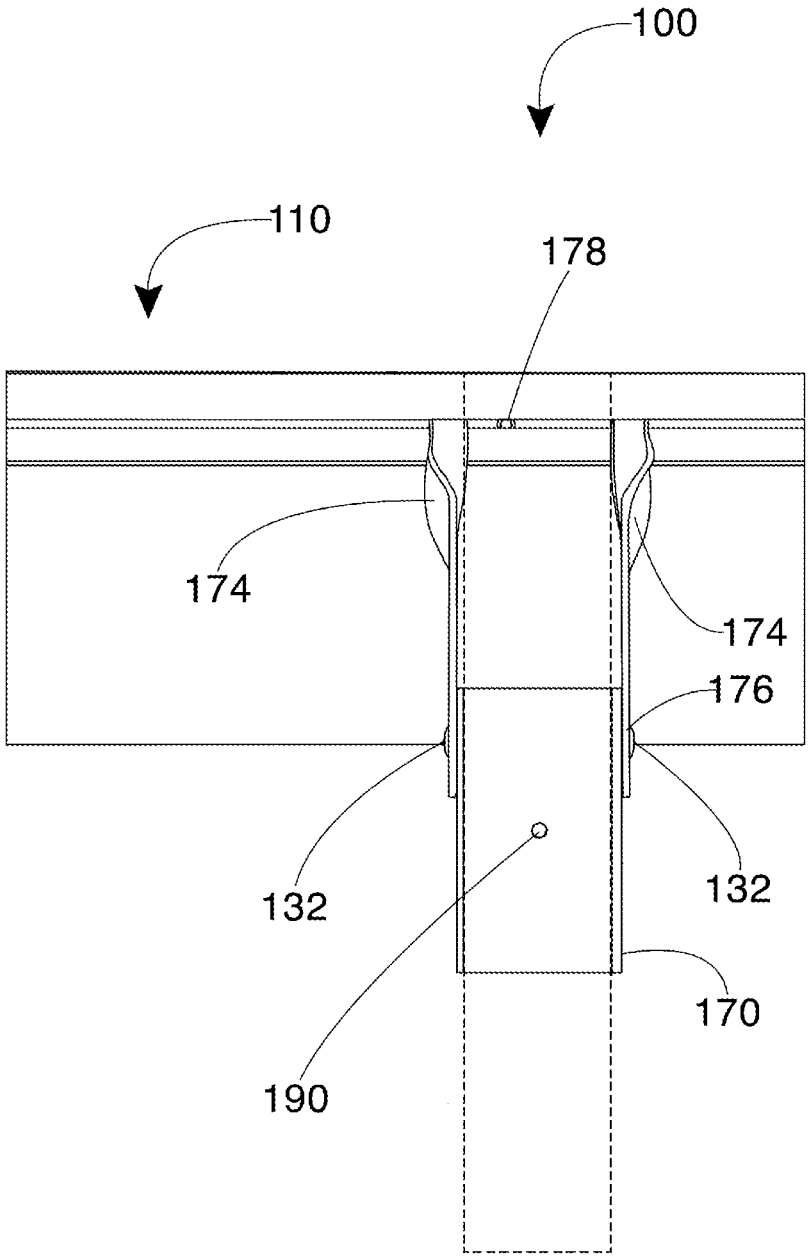
FIG. 4 is a rear view of the roof sheeting anchoring system of FIGS. 1-3, according to an embodiment of the present disclosure.

FIG. 1 shows roof sheeting anchoring system 100 during an 'in-use' condition, according to an embodiment of the present disclosure. Here, the roof sheeting anchoring system 100 may more positively secure a roof 5 or roof assembly to a truss 10 or truss assembly for improved structural stability. As illustrated, roof sheeting anchoring system 100 may include channel assembly 110 and anchor assembly 121 which comprises one or more anchoring bodies 120 and foot 170.

According to one embodiment, roof sheeting anchoring system 100 may be arranged as a kit 105. In particular, roof sheeting anchoring system 100 may further include a set of instructions 155. The instructions 155 may detail functional relationships in relation to the structure of roof sheeting anchoring system 100 such that the roof sheeting anchoring system 100 can be used, maintained, or the like, in a preferred manner.

As shown in the views of FIGS. 1-4, channel assembly 110, may include rectangular channel 112 with opening 114 and flap 116, with flap 116 affixed at substantially 90 degrees to a side of rectangular channel 112. Channel assembly 110 may include one or more holes 178 structured and arranged to accept nails or fasteners. In various embodiments, each of holes 178 may receive various fasteners, such as rivets, threaded fasteners, nails, screws, and others. Anchoring bodies 120 may be insertable into and removable from channel assembly 110.

Anchoring bodies 120 may each include elongate member 130 having a flat and tapered end 122 and rounded end 128 (near foot 170). Truss-anchor hook 124 is affixed to flat and tapered end 122. Flat and tapered end 122 may include a twist of substantially 90 degrees.

A pair of attachment points 132 near rounded end 128 is also included. Anchoring bodies 120 are each removably insertable into channel assembly 110. Anchoring bodies 120 may include at least one opening structured and arranged to accept a fastener (e.g., screw, standard nail, ring-shank nail, bolt, rivet, etc.). In some embodiments, the device comprises two anchoring bodies 120. These anchoring bodies 120 may be removable and slidable with respect to each other via first and second pairs of slidable tabs 174. The anchoring bodies 120 may include at least one anchor aperture 180. In various embodiments, each anchor aperture 180 may receive various fasteners, such as rivets, threaded fasteners, nails, screws, and others. In some embodiments, opening 114 comprises long tabs 115 that run the length of channel 112. In these or other embodiments, truss-anchor hook 124 engages long tabs 115

Foot 170 may be rotatably affixable to both of anchoring bodies 120 at attachment points 132. Also, foot 170 may be removably and rotatably coupleable to anchoring bodies 120 through attachment points 132. Preferably, there are two attachment points 132. Foot 170 may include at least one foot aperture 190 in addition to attachment points 132 that can accept a fastener (e.g., screw, standard nail, ring-shank nail, bolt, rivet, etc.). Attachment points 132 may include an aperture 176 and rivet (or other suitable rotative fastening device, including, but not limited to threaded fasteners. Foot 170 may also include one or more apertures able to accept fasteners such as screws, rivets, nails, or others. Such apertures may be useful for securing foot 170 to truss 10.

System 100 may be constructed from a ferrous material, a non-ferrous material, a composite material, or a plastic material. Also, system 100 may include a galvanized or anodized coating in some embodiments.

System 100 may be structured and arranged to provide a secure attachment between the roof structure and a truss 10 to prevent separation between roof 5 and truss 10. For the purposes of this specification, roof 5 may be a roof sheathing or covering, and not necessarily only a structural roof.

Figure 5:
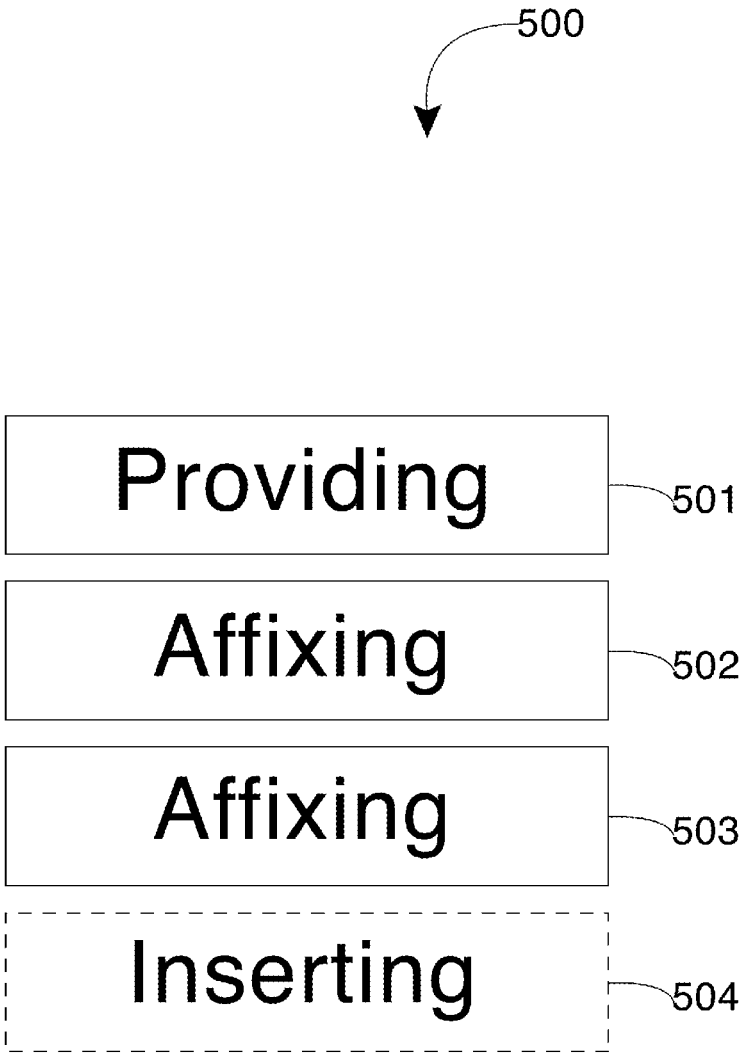
FIG. 5 is a flow diagram illustrating a method of using a roof sheeting anchoring system, according to an embodiment of the present disclosure.

FIG. 5 is a flow diagram illustrating a method of using a roof sheeting anchoring system 500, according to an embodiment of the present disclosure. In particular, a method of using a roof sheeting anchoring system 500 may include one or more components or features of the roof sheeting anchoring system 100 as described above. As illustrated, a method of using a roof sheeting anchoring system 500 may include the steps of step one 501, providing roof sheeting anchoring system 100, system 100 including channel assembly 110, anchoring body 120, and foot 170; step two 502, affixing channel assembly 110 to roof sheeting; step three 503, affixing foot 170 around the bottom of a truss 10; and step four 504, inserting fasteners into anchoring system 100 and therefore into the building (roof 5).

It should be noted that step four 504 is an optional step and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference.

The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other method of using a roof sheeting anchoring system 500 (NOTE: e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

Upon reading this specification, it should be appreciated that, under appropriate circumstances, considering such issues as user preferences, design preference, structural requirements, marketing preferences, cost, available materials, technological advances, etc., other structural and mechanical arrangements such as, for example, alternate arrangements, materials, orientations, etc., may be sufficient.

Those with ordinary skill in the art will now appreciate that upon reading this specification and by their understanding the art of structural engineering and building design as described herein, methods of securement and construction will be understood by those knowledgeable in such art.

What is claimed is new and desired to be protected by Letters Patent is set forth in the appended claims:

1. A roof sheeting anchoring system comprising:

a channel assembly having a rectangular channel with an opening, two long tabs extending inward on two sides of the opening and extending along the channel, and a flap extending from a corner of the channel, along the channel, and coplanar to a side of the channel;

two anchoring bodies each comprising an elongate member with a flat and tapered end and another end, a truss-anchor hook connected to the flat and tapered end; and a pair of attachment points located near the other end; and a foot affixed to both of the anchoring bodies at the attachment points, wherein the anchoring bodies are each removably insertable into the channel assembly; and wherein the system is structured and arranged to provide secure attachment of a roof structure to a truss.

2. The system of claim 1 wherein the flat and tapered end includes a twist of about 90 degrees.

3. The system of claim 2 wherein the system comprises ferrous or non-ferrous metal.

4. The system of claim 3 wherein the system includes a galvanized or anodized coating.

5. The system of claim 4 wherein a fastener affixes the foot to the anchoring bodies at the attachment points.

6. The system of claim 5 wherein the channel assembly includes a plurality of nail or screw holes.

7. The system of claim 6 wherein the anchoring bodies include at least one nail or screw hole.

8. The system of claim 7 wherein the foot includes at least one nail or screw hole in addition to the attachment points.

9. The system of claim 8 wherein the anchoring bodies are removably engageable with the long tabs.

10. The system of claim 9 wherein the foot is rotatably attached to the anchoring bodies.

11. The system of claim 10 wherein the elongate member comprises two opposing truss-anchor hooks.

12. The system of claim 11 wherein the anchoring bodies are each removably insertable into the channel assembly at a plurality of positions along the channel assembly.

13. The system of claim 12 wherein the anchoring bodies are removably engageable with the long tabs at a plurality of positions along the channel assembly.

14. The system of claim 13 wherein the flap is configured to trap an edge of a sheet of roofing material.

15. The system of claim 14 is configured to cup a bottom portion of a truss.

16. The system of claim 1 wherein the system comprises a plastic or a composite material.

17. A roof sheeting anchoring system comprising:

a channel assembly having a rectangular channel with an opening, two long tabs extending inward on two sides of the opening and extending along the channel, and a flap extending from a corner of the channel, along the channel, and coplanar to a side of the channel;

two anchoring bodies each comprising an elongate member with a flat and tapered end and a rounded end, a truss-anchor hook connected to the flat and tapered end; and a pair of attachment points located near the rounded end; and a foot affixed to both of the anchoring bodies at the attachment points, wherein the anchoring bodies are each removably insertable into the channel assembly;

the flat and tapered end includes a twist of about 90 degrees;

the anchoring bodies including at least one nail or screw hole;

a fastener affixes the foot to the anchoring bodies at the attachment points;

the anchoring bodies are each removably insertable into the channel assembly at a plurality of positions along the channel assembly;

the foot is removably and rotatably coupleable to the anchoring bodies through the attachment points;

the foot includes at least one nail, rivet, or screw hole in addition to the attachment points;

the system is constructed from a ferrous material and the system includes a galvanized coating; and the system is structured and arranged to provide secure attachment of a roof structure to a truss.

18. The system of claim 17 arranged with a set of instructions as a kit.

* * * * *